US005251449A

United States Patent [19]

Rottmann

[11] Patent Number: 5,251,449

[45] Date of Patent: Oct. 12, 1993

[54] PROCESS AND APPARATUS FOR AIR FRACTIONATION BY RECTIFICATION

[75] Inventor: Dietrich Rottmann, München, Fed. Rep. of Germany

[73] Assignee: Linde Aktiengesellschaft, Wiesbaden, Fed. Rep. of Germany

[21] Appl. No.: 929,180

[22] Filed: Aug. 13, 1992

[30] Foreign Application Priority Data

Aug. 14, 1991 [DE] Fed. Rep. of Germany ..... 4126945

[51] Int. Cl.[5] ..... F25J 3/04

[52] U.S. Cl. ..... 62/22; 62/41

[58] Field of Search ..... 62/22, 41

[56] References Cited

U.S. PATENT DOCUMENTS

| | | | |
|---|---|---|---|
| 4,533,375 | 8/1985 | Erickson | 62/22 |
| 4,575,388 | 3/1986 | Okada | 62/22 |
| 4,747,860 | 3/1988 | Atkinson | 62/22 |
| 4,822,395 | 4/1989 | Cheung | 62/22 |
| 4,932,212 | 6/1990 | Rohde | 62/22 |
| 4,935,044 | 6/1990 | Schoenpflug | 62/22 |
| 5,034,043 | 6/1991 | Rottmann | 62/22 |
| 5,036,672 | 8/1991 | Rottmann | 62/24 |

*Primary Examiner*—Ronald C. Capossela
*Attorney, Agent, or Firm*—Millen, White, Zelano & Branigan

[57] ABSTRACT

For air fractionation by two-stage rectification with subsequent production of crude argon, a component stream of the crude argon stream (25, 31) withdrawn from the crude argon column (2) is condensed (35) in indirect heat exchange (34) with a liquid oxygen product stream (40) from the medium pressure column (4), the oxygen product stream (40) being partially vaporized. The condensed crude argon (35) is then recycled into the crude argon column (20). A second component stream of the crude argon is obtained as the product (24).

18 Claims, 1 Drawing Sheet

PROCESS AND APPARATUS FOR AIR FRACTIONATION BY RECTIFICATION

BACKGROUND OF THE INVENTION

The present invention relates to the low temperature rectification of air combined with a crude argon rectification column.

In particular, the invention relates to a system for the fractionation of air by rectification, wherein air is compressed, purified, cooled, and preliminarily fractionated in the high pressure column of a two-stage rectification column into an oxygen-rich liquid and a nitrogen-rich fraction. The oxygen-rich liquid and/or nitrogen-rich fraction is bed, at least in part, to the medium pressure column of the rectification column and separated into oxygen and nitrogen, and an argon-containing oxygen stream and an oxygen product stream are withdrawn from the column. The argon-containing oxygen stream is introduced into a crude argon column operated under a pressure lower than the pressure of the medium pressure column, and crude argon is removed from the upper zone of this crude argon column. The invention also relates to an apparatus for performing this process.

Such a process, wherein crude argon is obtained following air fractionation, is known from DAS 3,905,521, corresponding to U.S. Pat. No. 5,036,672.

In this known process, the crude argon rectification is conducted under a pressure lower than the pressure at which the medium pressure column of the two-stage oxygen stream from the medium pressure column is engine-expanded before being introduced into the crude argon column.

In the head condenser of the crude argon column, gaseous crude argon is liquefied in indirect heat exchange with expanded oxygen-rich liquid withdrawn from the bottom of the high pressure column. The oxygen-rich fraction, vaporized during this step, is compressed and fed into the medium pressure column. The conventional process, owing to the low pressure in the crude argon column as compared with the medium pressure column, permits the production of crude argon without excessive losses in the yield of argon in conjunction with the fractionation of air into high pressure oxygen and high pressure nitrogen. However, the process also has drawbacks. In particular, the expansion and recompression of the oxygen-rich fraction for cooling the head of the crude argon column is very expensive. In addition, the vaporized proportion of the oxygen-rich fraction is fed in the gaseous phase into the medium pressure column and is, therefore, not available as reflux liquid. Thus, the rectification conditions in the medium pressure column are not entirely satisfactory. Furthermore, whereas the loss in yield in the argon column is not excessive, it is less than desirable.

SUMMARY OF THE INVENTION

Thus, the object of one aspect of the invention is to provide a process of the type discussed above such that the economics of argon production is improved.

Another object of the invention is to provide apparatus for conducting the improved process.

Upon further study of the specification and appended claims, further objects and advantages of this invention will become apparent to those skilled in the art.

The object of the process aspect of the invention is attained by removing the oxygen product stream in the liquid phase from the medium pressure column, condensing at least a portion of the gaseous crude argon withdrawn from the crude argon column in indirect heat exchange with said liquid oxygen product stream so as to at least partially vaporize the oxygen product stream, and reintroducing the resultant condensed crude argon into the crude argon column.

Several improvements can thereby be achieved as compared to the conventional process. Thus, the entire oxygen-rich fraction from the high pressure column can be fed in the liquid phase into the medium pressure column at a relatively high feedpoint, e.g., at about the 62nd in a column of 85 theoretical plates (counting from the bottom). A reflux ratio (liquid-to-vapor ratio) of approximately 1 can be achieved, e.g., from 1.05 to 1.25. There is no need to feed an oxygen-rich gaseous fraction into the medium pressure column.

The rectification in the medium pressure column is thereby markedly improved such that with the number of theoretical plates remaining the same, improved yields are obtained, especially in argon. Also, the crude argon column can be cooled economically with one of the fractions present, namely, the oxygen product from the medium pressure column.

The process according to the invention offers additional advantages if the pressure of the liquid oxygen product stream is increased prior to the indirect heat exchange with the condensing crude argon. It is true that it is conventional to pressurize oxygen in the liquid phase and then subject it to vaporization in order to obtain oxygen under elevated pressure. However, the compressed oxygen is normally vaporized against condensing feed air, the latter being subsequently introduced into the high pressure column, but this liquid introduction has negative effects on the rectification in the high pressure column.

In the process of this invention, however, no corresponding disadvantages are involved in the rectification of the pressurized oxygen product. On the contrary, the oxygen, pressurized in the liquid phase, is vaporized against a fraction, the liquefaction of which is desirable so that it can serve as a reflux in the crude argon column.

The increased pressure of the liquid oxygen can be accomplished, for example, by means of a pump or by the utilization of a hydrostatic head between the medium pressure column and the oxygen vaporizer.

It is also advantageous to heat, compress, and cool the crude argon in the process of this invention prior to indirect heat exchange with the liquid oxygen product stream.

The compression of the crude argon can take place in one or several stages. It is possible by means of the compressor or compressors to set the desired pressure of the crude argon, and, thereby, the pressure level of the vaporized oxygen product stream. The oxygen delivery pressure can thus be adjusted within a broad range without any substantial deviations in the desired conditions in the rest of the process.

Preferably, the condensed crude argon is subcooled after indirect heat exchange with the liquid oxygen product stream and is expanded prior to being introduced into the crude argon column. In this connection, it is advantageous to bring about the subcooling of the condensed crude argon by indirect heat exchange with crude argon withdrawn from the crude argon column.

In a further modification of the invention, the argon-containing oxygen stream from the medium pressure column is engine-expanded before introduction into the crude argon column, and the work obtained during engine expansion is utilized at least in part for the compression of crude argon. Thereby, the expenditure in external energy required for compression of the crude argon upstream of the condensation against vaporizing oxygen can be substantially reduced.

In a still further modification of the process of the invention, a portion, e.g., 25% to 35%, of the vaporized oxygen product stream can be introduced into the bottom part of the medium pressure column. In this way, one result of the crude argon condensation step is that it produces additional ascending gas in the bottom of the medium pressure column, thereby diminishing the load on the main condenser.

Preferably, a portion of the crude argon removed from the crude argon column is obtained as the product.

BRIEF DESCRIPTION OF THE DRAWING

A preferred comprehensive embodiment of the invention is illustrated in a schematic flowsheet.

However, before discussing the drawing in detail, attention is directed to the apparatus aspect of the invention.

Figure 1:
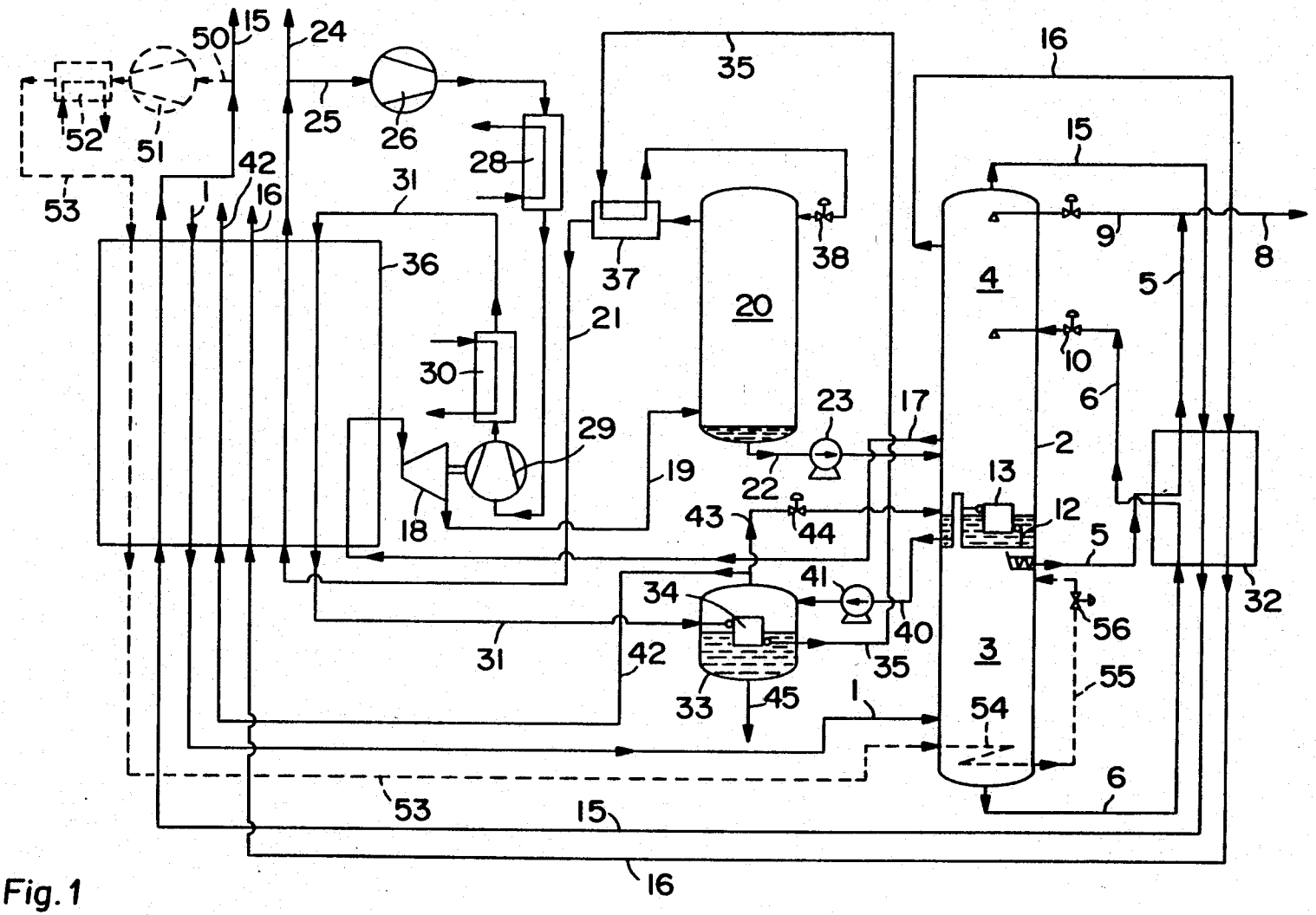

To accomplish the process, there is provided an apparatus (with reference to the drawing) comprising a rectifying column (2) having a high pressure column (3) and a medium pressure column (4), with a feed conduit (1) for compressed, purified, and cooled air, terminating in the high pressure column, with at least one connecting conduit (5, 6) between the high pressure column (3) and medium pressure column (4), with an argon transfer conduit (17, 19) leading from the medium pressure column (4) via a pressure-reducing device (18) to a crude argon column (2), and with a crude argon discharge conduit (21, 31) connected to the upper zone of the crude argon column (2), characterized by a condenser-evaporator (33, 34), the condensation side (34) of which is connected via a crude argon discharge conduit (21, 25, 31) and via a crude argon condensate conduit (35) to the crude argon column (20), and the evaporation side of which is connected via a liquid conduit (40) to the lower zone of the medium pressure column (4).

It is also preferred for the apparatus to be provided with a pump (41) arranged in the liquid conduit (40). It is likewise preferred that the condenser-evaporator (33, 34) be arranged at a lower level than the medium pressure column (4).

Another preferred modification of the apparatus comprises a compressor unit (26, 29) arranged in the crude argon discharge conduit (25). Moreover, it is advantageous for the apparatus to be provided with a crude argon subcooler (37), the warm passages of which are connected to the crude argon condensate conduit (35); and, desirably, the cold passages of the crude argon subcooler (37) are connected to the crude argon discharge conduit (21).

It is also preferred that the pressure-reducing device (18) in the argon transfer conduit (17, 19) comprises expansion engine (18), and especially one which can be mechanically coupled with at least one compressor.

The apparatus is also benefitted by a vapor conduit (43) leading from the evaporation side (33) of the condenser-evaporator into the lower zone of the medium pressure column (4).

DETAILED DESCRIPTION OF THE DRAWING

Compressed and prepurified air is introduced via conduit 1, cooled in a heat exchanger 36 in indirect heat exchange with product streams, and fed into a high pressure column 3 of a two-stage rectification column 2 provided with a conventional condenser/vaporizer. The high pressure column 3 (operating pressure: 6–20 bar, preferably 8–17 bar) is in heat-exchange with a medium pressure column 4 (operating pressure: 1.5–10 bar, preferably 2.0–8 bar) by way of a condenser/vaporizer 13. The introduced air is preliminarily fractionated in the high pressure column into nitrogen and an oxygen-enriched fraction. The oxygen-enriched fraction is removed in the liquid condition at the bottom of the high pressure column via a conduit 6, subcooled in a heat exchanger 32, and fed via a throttling valve 10 back into the medium pressure column 4. Nitrogen from the head of the high pressure column 3 is similarly withdrawn via a conduit 5 in the liquid phase, subcooled in the heat exchanger 32, and one part is removed as the liquid product via a conduit 8. The other part of the nitrogen from the high pressure column 3 is introduced as reflux via a conduit 9 into the medium pressure column 4.

Liquid oxygen (conduit 40), gaseous pure nitrogen (conduit 15), and impure nitrogen (conduit 16) are withdrawn as the products from the medium pressure column 4, and the two nitrogen fractions are heated in heat exchangers 32 and 36.

If the refrigerating power of a turbine 18 is inadequate for the process, it is advantageous, owing to the relatively high pressure in the medium pressure column 4, to utilize the impure nitrogen in the conduit 16 for supplemental process cold. However, the process steps required for this purpose are not shown in the drawing.

In addition to the streams described above, an argon-containing oxygen stream is also withdrawn from the medium pressure column 4 by way of conduit 17, heated in heat exchanger 36, and fed into the crude argon column 20, the latter being operated under a pressure of 1.1 to 2 bar, preferably 1.3 to 1.5 bar. The residual fraction obtained at the bottom of the crude argon column 20 is removed via conduit 22 and brought by means of pump 23 to the pressure needed for return into the medium pressure column 4. Further, the argon-rich oxygen stream 17 is engine-expanded in the expansion turbine 18 before being introduced via the transfer conduit 19 into the crude argon column 20 in order to bring the argon-rich oxygen stream to the low pressure ambient in the crude argon column 20, on the one hand, and to generate needed process cold, on the other hand.

The gaseous crude argon obtained at the head of the crude argon column 20 is withdrawn via conduit 21, heated in heat exchanger 37 against condensed crude argon to be cooled, heated in heat exchanger 36, and subsequently divided into two component streams 24 and 25. The crude argon stream in conduit 24 is discharged from the facility to the consumer as an intermediate product. The crude argon stream in conduit 25, not removed from the facility, is compressed in two compressor stages 26 and 29 and, in each case, subsequently cooled (water coolers 28 and 30). The crude argon stream is then conducted by way of conduit 31 through the heat exchanger 36, further cooled therein, and subsequently conducted into the condenser 34 installed in the condenser-evaporator 33. In condenser 34, the crude argon is condensed against liquid oxygen introduced via conduit 40 with the aid of pump 41. The thus-condensed crude argon is then conducted by way of conduit 35 into the heat exchanger 37, cooled in the latter against crude argon withdrawn from the crude argon column 20, and expanded via valve 38 into the crude argon column 20.

The liquid oxygen product stream under pressure, conducted via conduit 40 and with the aid of pump 41 into the condenser-evaporator 33, is partially vaporized in indirect heat exchange with the component stream of the crude argon fed via conduit 31. The vapor-phase fraction of oxygen product stream is discharged by way of conduit 42 after being heated in heat exchanger 36. Via conduit 43 and valve 44, a portion of the gaseous oxygen product stream not required for delivery can be expanded again into the bottom of the medium pressure column. A liquid oxygen product stream can be obtained from the condenser-evaporator 33 by way of conduit 45.

The process steps indicated in dashed lines in the figure represent an additional nitrogen booster cycle.

Via conduit 50, a portion of the nitrogen fraction is withdrawn from conduit 15, compressed in compressor 51, subsequently cooled in water cooler 52, and conducted via conduit 53, after subcooling in heat exchanger 36, into the heating coil 54 mounted in the bottom of the high pressure column 3. The thus-formed nitrogen condensate is introduced via conduit 55 and valve 56 into the upper zone of the high pressure column, above or below the withdrawal point for the liquid nitrogen (conduit 5) (the drawing shows, for the sake of clarity, the introduction below the withdrawal point). The nitrogen condensate introduced under throttling in the upper region of the high pressure column has a positive effect in the medium pressure column for argon production, since the reflux relationships in the medium pressure column are improved by the additional nitrogen feed.

Furthermore, the amount of air required can be reduced by the bottom heating unit 54 to such an extent that an oxygen purity at any low level desired can be realized in the impure nitrogen.

The process according to this invention can be utilized with special advantage in combined-cycle processes, where air separation installations are integrated with power plants, coal gasification plants or other installations which comprise a gas turbine (e.g., for steel manufacture). In such combined-cycle plants, the gas turbine driven by hot flue gases deliver all or part of the energy for air pressurization, preferably be direct mechanical coupling between gas turbine and air compressor. A part of the compressed air may not be separated but used for combustion or other chemical reactions. The integrated air separation plant is usually operated at a relatively high pressure, e.g., 2 to 10 bars in the medium pressure column.

Further, it is advantageous to use random or structured packings in one column, in several columns, or in each of the columns (high pressure column, low pressure column, crude argon column). In this connection, it is also possible to fill partial zones of a column with a packing, while other regions are provided with plates, for example.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

The entire disclosure of all applications, patents and publications, cited herein, and of corresponding German P 41 26 945.4, filed Aug. 14, 1991, are hereby incorporated by reference.

What is claimed is:

1. In an air fractionation process by rectification, wherein air (1) is compressed, purified, cooled (36), and preliminarily fractionated in a high pressure column (3) of a two-stage rectification column (2) into an oxygen-rich liquid (6) and into a nitrogen-rich fraction (5), the oxygen-rich liquid (6) and/or nitrogen-rich fraction (5) being fed at least in part to the medium pressure column (4) of the rectification column (2) and separated into oxygen and nitrogen, and wherein an argon-containing oxygen stream (17) and an oxygen product stream (40) are withdrawn from the medium pressure column (4), the argon-containing oxygen stream being introduced into a crude argon column (20) operated under a pressure lower than the pressure of the medium pressure column (4), and gaseous crude argon (21) being removed from an upper zone of said crude argon column, the improvement wherein the oxygen product stream (40) is discharged in the liquid condition from the medium pressure column (4), at least a portion (31) of the gaseous crude argon withdrawn from the crude argon column (20) is condensed in indirect heat exchange (34) against the liquid oxygen product stream (40), the oxygen product stream (40) being at least partially vaporized, and resultant condensed crude argon (35) is reintroduced into the crude argon column (20).

2. A process according to claim 1, wherein the pressure of the liquid oxygen product stream (40) is increased prior to indirect heat exchange (33, 34) with the condensing crude argon.

3. A process according to claim 1, wherein prior to indirect heat exchange (34) with the liquid oxygen product stream, the crude argon (25) is heated (37), compressed (26, 29), and cooled (28, 30, 36).

4. A process according to claim 3, wherein the argon-containing oxygen stream (17) from the medium pressure column (4) is engine-expanded prior to being introduced into the crude argon column (20), and work obtained during engine expansion is utilized at least in part for the compression (29) of crude argon (25).

5. A process according to claim 1, wherein after the indirect heat exchange with the liquid oxygen product, the condensed crude argon (35) is subcooled (37) and expanded (38) prior to being introduced into the crude argon column (20).

6. A process according to claim 4, wherein the subcooling of the condensed crude argon (35) is effected by indirect heat exchange (37) with crude argon withdrawn from the crude argon column (20).

7. A process according to claim 1, wherein a portion of the vaporized oxygen product stream is fed (43) into the lower part of the medium pressure column.

8. A process according to claim 1, wherein a portion of the crude argon (21) withdrawn from the crude argon column (20) is obtained as a product (24).

9. The process of claim 1, wherein at least a portion of the crude argon is recovered as product.

10. In an apparatus for performing the process of claim 1, comprising a crude argon column (2) and a two-stage rectification column (2) provided with a high pressure column (3) and a medium pressure column (4), a feed conduit (1) for compressed, purified, and cooled air, terminating in the high pressure column, with at least one connecting conduit (5, 6) between the high pressure column (3) and the medium pressure column (4), with an argon transfer conduit (17, 19) leading from the medium pressure column (4) via pressure-reducing means (18) to a crude argon column (20) and a crude argon discharge conduit (21, 23) connected to the upper zone of the crude argon column (20), the improvement comprising a condenser-evaporator (33, 34), the condensation side (34) being connected via the crude argon condensate discharge conduit (21, 25, 31) and via a crude argon condensate conduit (35) to the crude argon column (20), and the evaporation side being connected via a liquid conduit (40) to a lower zone of the medium pressure column (4).

11. Apparatus according to claim 10, further comprising a pump (41) arranged in the liquid conduit (40).

12. Apparatus according to claim 10, wherein the condenser-evaporator (33, 34) is arranged at a lower level than the medium pressure column (4).

13. Apparatus according to claim 10, further comprising a compressor unit (26, 29) arranged in the crude argon discharge conduit (25).

14. Apparatus according to claim 13, wherein the compressor unit comprises at least one compressor mechanically coupled with an expansion engine (18).

15. Apparatus according to claim 10, further comprising a crude argon subcooler (37), the warm passages thereof being connected to the crude argon condensate conduit (35).

16. Apparatus according to claim 15, the cold passages of the crude argon subcooler (37) being connected to the crude argon discharge conduit (21).

17. Apparatus according to claim 10, wherein the pressure-reducing device (18) in the argon transfer conduit (17, 19) comprises an expansion engine.

18. Apparatus according to claim 10, further comprising a vapor conduit (43) leading from the evaporation side (33) of the condenser-evaporator into the lower zone of the medium pressure column (4).

* * * * *